US006109548A

United States Patent [19]

George et al.

[11] Patent Number: 6,109,548

[45] Date of Patent: Aug. 29, 2000

[54] SPRAYER SYSTEM

[76] Inventors: Vernon George, 1505 -- 65th St. North, Deering, N. Dak. 58731; Dean C. Solberg, 7950 Hwy. 2 East, Lot 109, Minot, N. Dak. 58701-9380

[21] Appl. No.: 09/346,630

[22] Filed: Jul. 1, 1999

[51] Int. Cl.[7] ..... B05B 9/04

[52] U.S. Cl. ..... 239/373; 222/333; 417/425

[58] Field of Search ..... 239/332, 373; 222/333, 401; 417/374, 425

[56] References Cited

U.S. PATENT DOCUMENTS

| | | | |
|---|---|---|---|
| 2,818,299 | 12/1957 | Payne | 239/373 X |
| 3,993,245 | 11/1976 | Smith | 239/373 X |
| 4,154,401 | 5/1979 | Thompson | 239/373 |
| 4,651,903 | 3/1987 | Pagliai | 222/333 X |
| 4,881,687 | 11/1989 | Ballu | 239/332 |
| 5,765,580 | 6/1998 | Dassi | 239/373 X |

*Primary Examiner*—Lesley D. Morris
*Attorney, Agent, or Firm*—Michael S. Neustel

[57] ABSTRACT

A sprayer system for reducing the need to manually create pressure within a portable spray unit. The inventive device includes a reservoir, a manual pump, an electric motor, a battery electrically connected to the electric motor, an air compressor mechanically connected to the electric motor, a valve stem within the reservoir, and a safety valve within the reservoir. The valve stem can be utilized by a user to connect a conventional air tank thereto for inserting high amounts of air pressure directly into the reservoir without requiring the use of the manual pump or electric pump. If a power switch is closed, the electric motor will operate the air compressor whenever the air pressure within the reservoir drops below a predetermined level. When the air pressure within the reservoir rises above a predetermined level, the electric motor is deactivated thereby preventing the reservoir from becoming over-pressurized. The manual pump may be utilized when the electric pump fails or the battery becomes discharged.

19 Claims, 3 Drawing Sheets

SPRAYER SYSTEM

BACKGROUND OF THE INVENTION

1. Field of the Invention

The present invention relates generally to spray devices and more specifically it relates to a sprayer system for reducing the need to manually create pressure within a portable spray unit.

When utilizing a conventional portable sprayer for dispersing herbicides, insecticides or other chemicals, a user must first manually pump the portable sprayer until a desired air pressure within the portable sprayer is achieved. The user thereafter opens a valve on the nozzle for allowing disbursement of the fluid within the portable sprayer. After a period of time the pressure lowers to a level where the spray pattern from the nozzle begins to deteriorate leading to poor coverage. The user must then stop spraying and pump the portable sprayer until the desired air pressure is achieved again. This process continues until the user is finished. Hence, there is a need for a portable sprayer that does not require the user to constantly stop to manually pump the pressure within the reservoir and that maintains a relatively consistent spray pattern.

2. Description of the Prior Art

Portable sprayers have been in use for years. Typically, a conventional portable sprayer will have a reservoir, a nozzle, and a manual pump with a handle. The user must constantly manipulate the manual pump to maintain a desirable pressure within the reservoir.

The main problem with conventional portable sprayer devices is that the spray pattern begins to deteriorate over time as the air pressure within the reservoir lowers. Another problem is that the user must constantly stop to manually pump the portable sprayer to maintain a desirable pressure within the reservoir which is time consuming. Another problem is that manually pumping the portable spray device can be physically demanding over the course of a workday leading to worker fatigue and dissatisfaction.

Examples of portable spraying apparatuses include U.S. Pat. No. 4,651,903 to Pagliai; U.S. Pat. No. 2,958,155 to Emmerich; U.S. Pat. No. 3,421,697 to Marks; U.S. Pat. No. 4,881,687 to Ballu; U.S. Pat. No. 3,758,036 to Bauder; U.S. Pat. No. 4,925,105 to Lin; U.S. Pat. No. 4,801,088 to Baker; U.S. Pat. No. 5,752,661 to Lewis; U.S. Pat. No. 4,790,454 to Clark; U.S. Pat. No. 3,993,250 to Shure; U.S. Pat. No. 4,600,129 to Kondo; U.S. Pat. No. 4,645,128 to Graber; and U.S. Pat. No. 5,716,007 to Nottinghamare all are illustrative of such prior art.

Pagliai (U.S. Pat. No. 4,651,903) discloses a motorized pump pressurized liquid sprayer. Pagliai teaches a reservoir, spray nozzle, support stand and a motorized pump for creating pressure within said reservoir.

Emmerich (U.S. Pat. No. 2,958,155) discloses a portable spraying apparatus. Emmerich teaches a motor, a blower, and a reservoir for spraying insecticides.

Marks (U.S. Pat. No. 3,421,697) discloses a spray equipment device. Marks teaches a body harness attached to the back support frame, an engine, a fan unit, a reservoir, and a flexible duct.

Ballu (U.S. Pat. No. 4,881,687) discloses a portable liquid sprayer for the treatment of plants. Ballu teaches a reservoir, an electric pump, and spray assembly.

While these devices may be suitable for the particular purpose to which they address, they are not as suitable for reducing the need to manually create pressure within a portable spray unit. Conventional spray devices do not provide a combination manual and electrical pump system. In addition, conventional spray devices do not maintain a constant air pressure within the reservoir.

In these respects, the sprayer system according to the present invention substantially departs from the conventional concepts and designs of the prior art, and in so doing provides an apparatus primarily developed for the purpose of reducing the need to manually create pressure within a portable spray unit.

SUMMARY OF THE INVENTION

In view of the foregoing disadvantages inherent in the known types of portable spray devices now present in the prior art, the present invention provides a new sprayer system construction wherein the same can be utilized for reducing the need to manually create pressure within a portable spray unit.

The general purpose of the present invention, which will be described subsequently in greater detail, is to provide a new sprayer system that has many of the advantages of the portable spray devices mentioned heretofore and many novel features that result in a new sprayer system which is not anticipated, rendered obvious, suggested, or even implied by any of the prior art portable spray devices, either alone or in any combination thereof.

To attain this, the present invention generally comprises a reservoir, a manual pump, an electric motor, a battery electrically connected to the electric motor, an air compressor mechanically connected to the electric motor, a valve stem within the reservoir, and a safety valve within the reservoir. The valve stem can be utilized by a user to connect a conventional air tank thereto for inserting high amounts of air pressure directly into the reservoir without requiring the use of the manual pump or electric pump. If a power switch is closed, the electric motor will operate the air compressor whenever the air pressure within the reservoir drops below a predetermined level. When the air pressure within the reservoir rises above a predetermined level, the electric motor is deactivated thereby preventing the reservoir from becoming over-pressurized. The manual pump may be utilized when the electric pump fails or the battery becomes discharged.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a sprayer system that will overcome the shortcomings of the prior art devices.

Another object is to provide a sprayer system that maintains a constant pressure within the reservoir.

An additional object is to provide a sprayer system that reduces the number of times a user must manually pump the portable spray unit.

A further object is to provide a sprayer system that makes utilizing a portable sprayer easier and enjoyable.

Another object is to provide a sprayer system that increases the amount of coverage.

A further object is to provide a sprayer system that decreases the amount of time to accomplish a spray job.

An additional object is to provide a sprayer system that maintains a constant spray pattern.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DESCRIPTION OF THE PREFERRED EMBODIMENT

Figure 1:
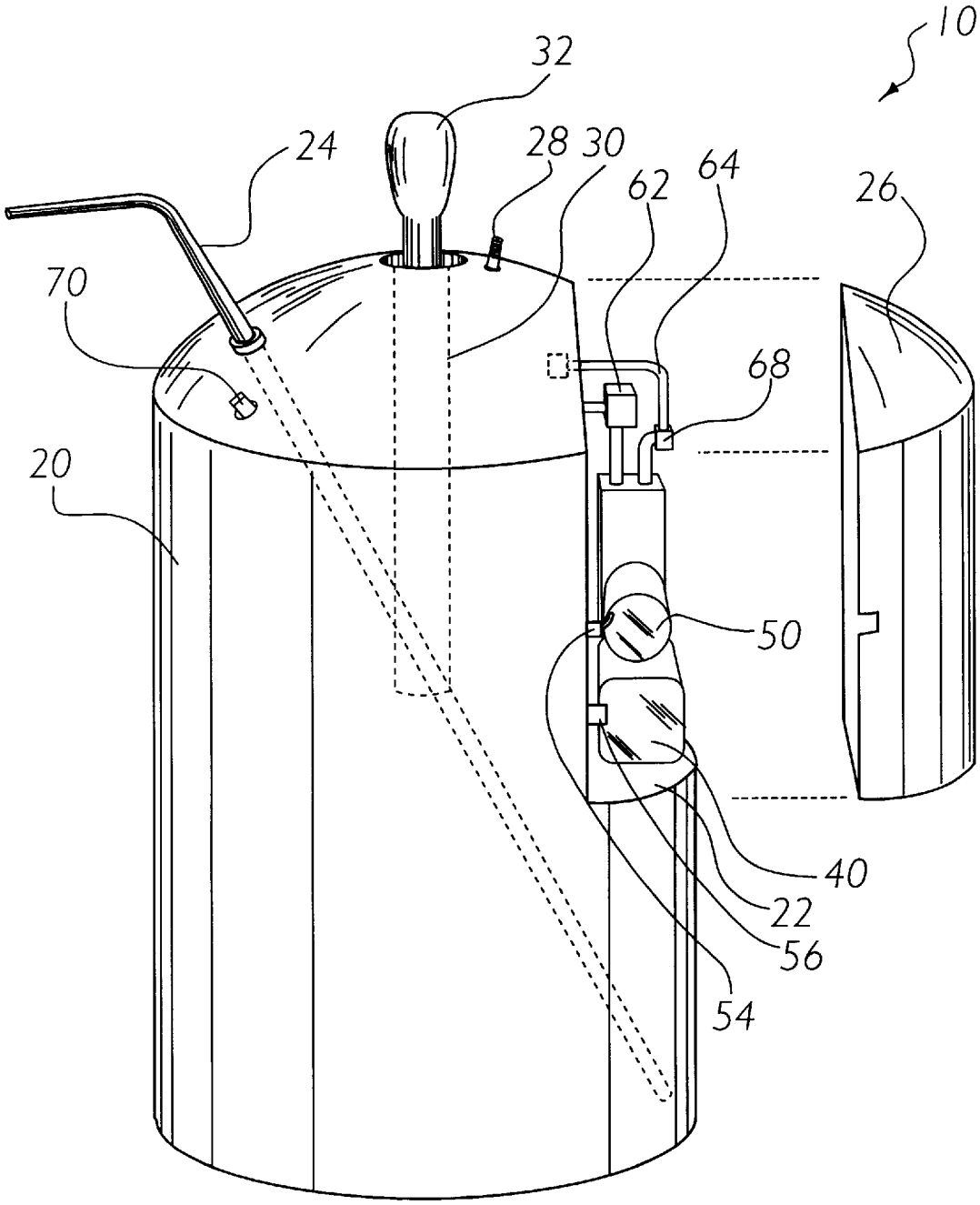
FIG. 1 is a side upper perspective view of the present invention.
Figure 2:
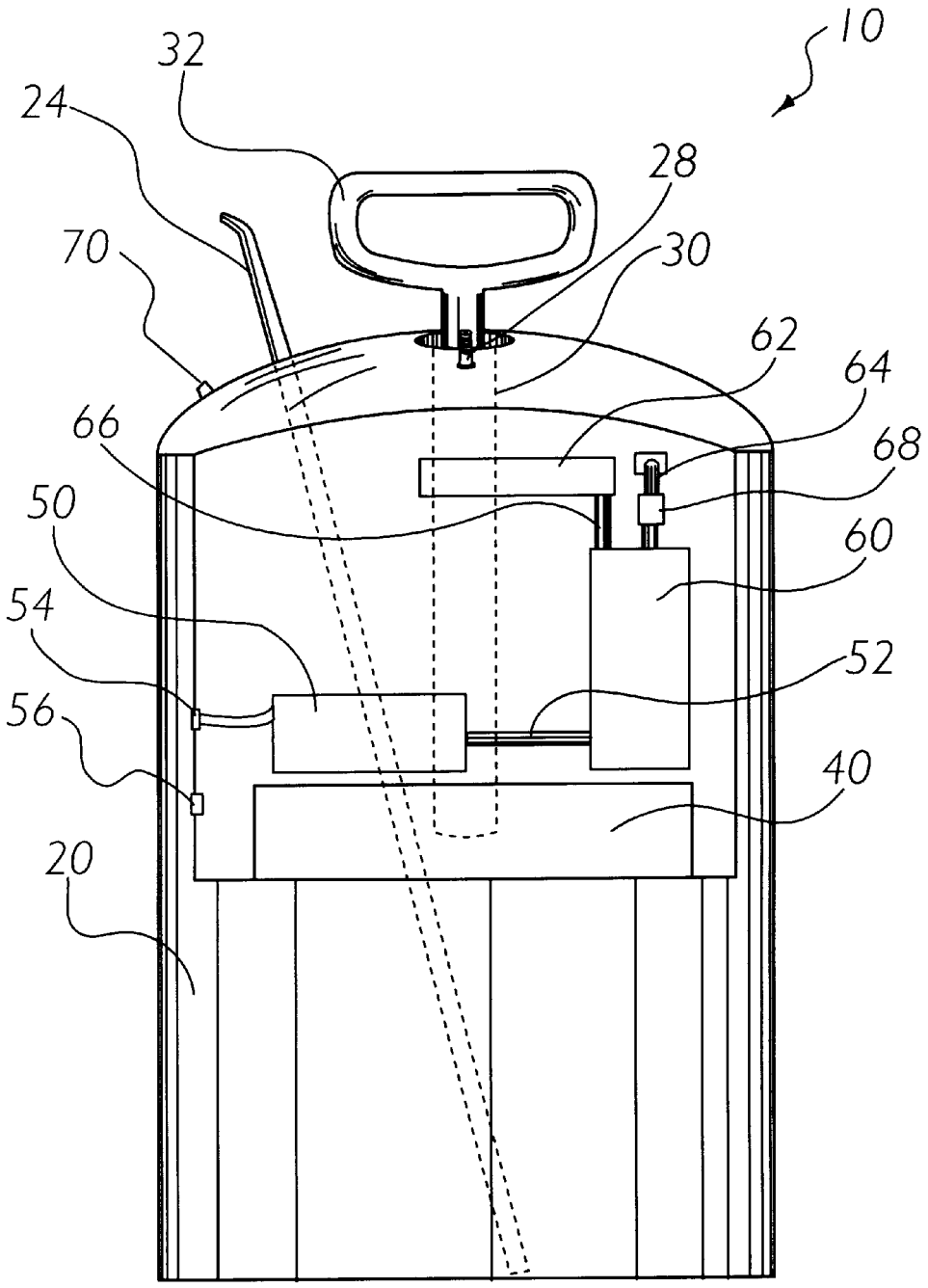
FIG. 2 is a rear upper perspective view of the present invention.
Figure 3:
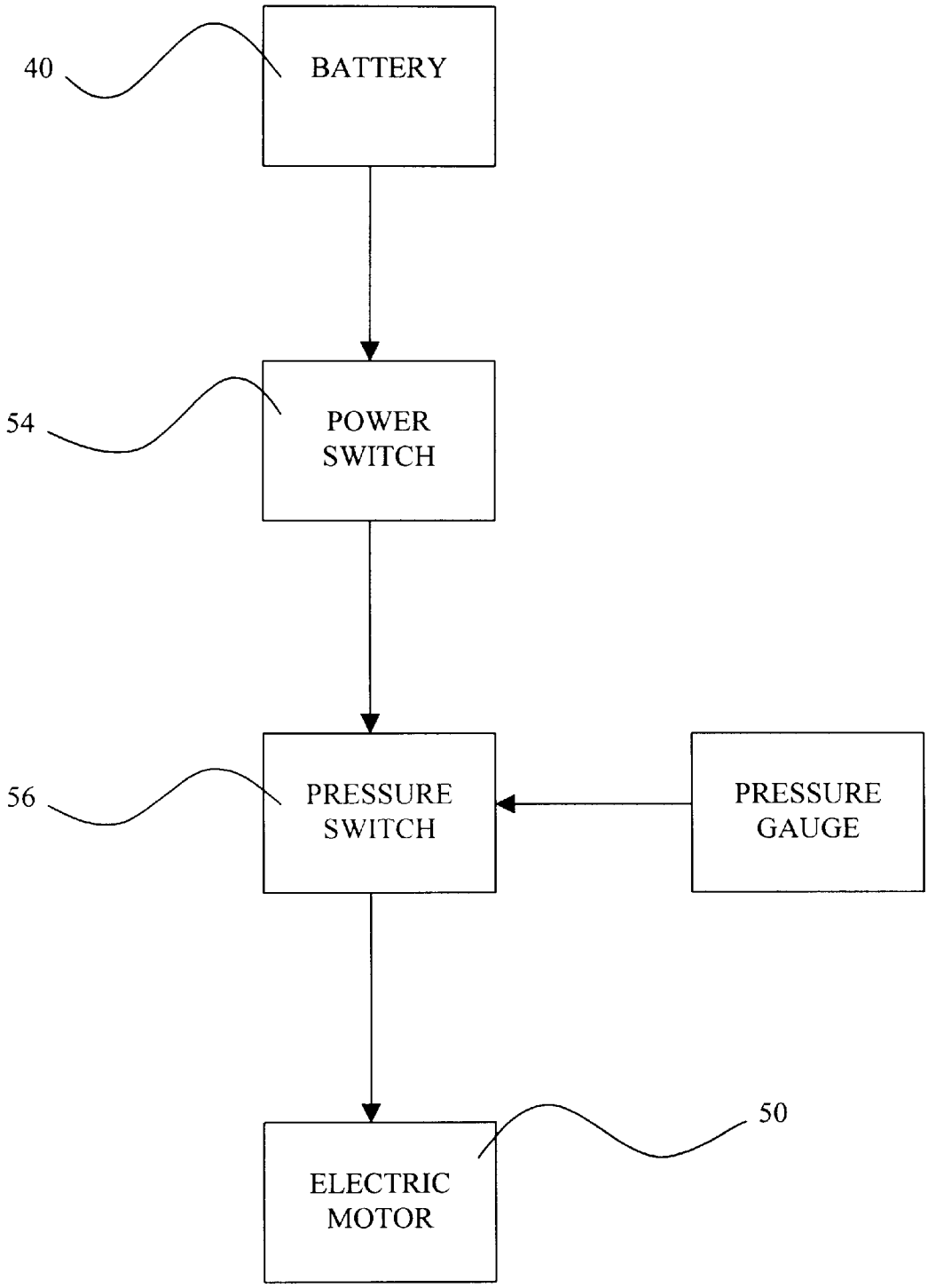
FIG. 3 is a block diagram illustration of the electronic circuitry for the present invention.

Turning now descriptively to the drawings, in which similar reference characters denote similar elements throughout the several view, FIGS. 1 through 3 illustrate a sprayer system 10, which comprises a reservoir 20, a manual pump 30, an electric motor 50, a battery 40 electrically connected to the electric motor 50, an air compressor 60 mechanically connected to the electric motor 50, a valve stem 28 within the reservoir 20, and a safety valve 70 within the reservoir 20. The valve stem 28 can be utilized by a user to connect a conventional air tank thereto for inserting high amounts of air pressure directly into the reservoir 20 without requiring the use of the manual pump 30 or electric pump. If a power switch 54 is closed, the electric motor 50 will operate the air compressor 60 whenever the air pressure within the reservoir 20 drops below a predetermined level. When the air pressure within the reservoir 20 rises above a predetermined level, the electric motor 50 is deactivated thereby preventing the reservoir 20 from becoming overpressurized. The manual pump 30 may be utilized when the electric pump fails or the battery 40 becomes discharged.

As shown in FIGS. 1 and 2 of the drawings, a reservoir 20 is provided that is capable of storing a desirable amount of fluid such as herbicide or insecticide. The reservoir 20 may have any shape such as cylindrical or rectangular. The reservoir 20 includes an indention 22 for receiving and storing the electric motor 50, battery 40 and air compressor 60. A removable cover 26 is provided to selectively enclose the indention 22 during utilization.

A spray nozzle 24 is fluidly connected to the reservoir 20 and is fluidly connected to a tube that extends to a lower portion of the reservoir 20. As shown in FIGS. 1 and 2 of the drawings, a valve stem 28 is fluidly attached to the upper portion of the reservoir 20 for receiving significant air pressure from a conventional air tank. A safety valve 70 is also fluidly attached to an upper portion of the reservoir 20 for allowing the release of air pressure within the reservoir 20 if it should rise above a desirable level thereby preventing injury to the user and the equipment.

As further shown in FIGS. 1 and 2 of the drawings, a manual pump 30 is positioned within the reservoir 20 for allowing the user to create air pressure within the reservoir 20 manually. The manual pump 30 includes a handle 32 attached to a shaft that extends into the manual pump 30.

As shown in FIGS. 1 through 3, a power switch 54 is electrically connected to a battery 40 positioned within the indention 22 of the reservoir 20. The battery 40 is preferably rechargeable for allowing continuous reuse of the battery 40 and for reducing the number of times the battery 40 has to be removed from the indention 22. The battery 40 is retained within the reservoir 20 by any well-known attachment means.

A pressure gauge is connected to the reservoir 20 for reading the air pressure within the upper portion of the reservoir 20. The pressure gauge is electrically connected to the pressure switch 56 as shown in FIG. 3 of the drawings. The pressure gauge electrically communicates the air pressure within the reservoir 20 to the pressure switch 56.

The pressure switch 56 is electrically connected to the power switch 54 as shown in FIG. 3 of the drawings. The pressure switch 56 preferably has an adjustable high pressure level and an adjustable lower pressure level wherein the levels are adjustable by a knob. If the air pressure within the reservoir 20 is below the low pressure level, the pressure switch 56 becomes closed thereby providing electrical power to the electric motor 50 if the power switch 54 is closed. If the air pressure within the reservoir 20 is above the high pressure level, the pressure switch 56 becomes open thereby terminating electrical power to the electric motor 50.

The electric motor 50 is mounted within the indention 22 of the reservoir 20 as shown in FIGS. 1 and 2 of the drawings. The electric motor 50 is electrically connected to the pressure switch 56 as shown in FIG. 3 of the drawings opposite of the power switch 54.

As best shown in FIG. 2 of the drawings, a drive shaft 52 from the electric motor 50 is mechanically connected to the air compressor 60. The air compressor 60 is mounted within the indention 22 as shown in FIG. 2 of the drawings.

A filter manifold 62 is secured within the indention 22 of the reservoir 20 that filters the air coming into the air compressor 60. An intake tube 66 is fluidly connected between the filter manifold 62 and the air compressor 60 for providing outside clean air to the air compressor 60. A supply tube 64 is fluidly connected between the air compressor 60 and the upper portion of the reservoir 20 for supplying pressurized air to the reservoir 20. A check valve 68 is positioned within the supply tube 64 for preventing fluid from within the reservoir 20 from entering the supply tube 64 and the air compressor 60.

In use, the user closes the power switch 54 thereby allowing the electric motor 50 to operate the air compressor 60. Air is drawn through the filter manifold 62 into the intake tube 66 to the air compressor 60 where after it is forced through supply tube 64 into the reservoir 20. This process continues until the pressure gauge detects an interior air pressure within the reservoir 20 above the high pressure level, where after the pressure switch 56 opens thereby terminating electrical power to the electric motor 50. The user then opens a valve connected to the spray nozzle 24 thereby allowing the release of fluid from within the reservoir 20 through the spray nozzle 24 so that the user can apply the chemical in the desired locations. If fluid within the container should enter the supply tube 64, the check valve 68 will prevent the fluid from entering the air compressor 60. When the air pressure within the interior of the reservoir 20 is below a low pressure level, the pressure switch 56 is closed thereby supplying electrical power to the electric motor 50 thereby operating the air compressor 60. This process continues until the high pressure level is reached. If the user desires to not utilize the electric motor 50 and air compressor 60, the user can manually open the power switch 54 to prevent electrical power from battery 40 from passing to the electric motor 50 regardless of the pressure within the reservoir 20. If the electric motor 50 is not utilized, then the user must utilize either the manual pump 30 or the valve stem 28 to increase the air pressure within the reservoir 20.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A sprayer system, comprising:

reservoir having an indention;

a spray nozzle fluidly connected to said reservoir;

a manual pump within and fluidly connected to said reservoir; and an electric pump means within said indention and fluidly connected to said reservoir.

2. The sprayer system of claim 1, wherein said electric pump means comprises:

a battery;

a power switch electrically connected to said battery;

an electric motor electrically connected to said power switch; and an air compressor mechanically connected to said electric motor and fluidly connected to said reservoir by a supply tube.

3. The sprayer system of claim 2, wherein said electric pump means further comprises:

a pressure gauge fluidly connected to said reservoir; and a pressure switch electrically connected between said power switch and said electric motor, wherein said pressure gauge is in electrical communication with said pressure switch.

4. The sprayer system of claim 3, wherein said pressure switch has a high pressure level and a lower pressure level, wherein when an air pressure within said reservoir is above said high pressure level said pressure switch is open and wherein when said air pressure within said reservoir is below said low pressure level said pressure switch is closed.

5. The sprayer system of claim 4, wherein said high pressure level and said low pressure level are manually adjustable.

6. The sprayer system of claim 5, including a valve stem within said reservoir for allowing direct pressurization of said reservoir from a conventional air compressor tank.

7. The sprayer system of claim 6, including an air filter manifold fluidly connected to said air compressor by an intake tube.

8. The sprayer system of claim 7, wherein said supply tube includes a check valve.

9. The sprayer system of claim 8, including a safety valve within said reservoir for allowing the release of pressure within said reservoir if said air pressure rises above a dangerous level.

10. The sprayer system of claim 9, wherein said battery is rechargeable.

11. A sprayer system, comprising:

reservoir having an indention;

a cover for selectively enclosing said reservoir;

a valve stem positioned within and fluidly connected to said reservoir;

a spray nozzle fluidly connected to said reservoir;

a manual pump within and fluidly connected to said reservoir; and an electric pump means within said indention and fluidly connected to said reservoir.

12. The sprayer system of claim 11, wherein said electric pump means comprises:

a battery;

a power switch electrically connected to said battery;

an electric motor electrically connected to said power switch; and an air compressor mechanically connected to said electric motor and fluidly connected to said reservoir by a supply tube.

13. The sprayer system of claim 12, wherein said electric pump means further comprises:

a pressure gauge fluidly connected to said reservoir; and a pressure switch electrically connected between said power switch and said electric motor, wherein said pressure gauge is in electrical communication with said pressure switch.

14. The sprayer system of claim 13, wherein said pressure switch has a high pressure level and a lower pressure level, wherein when an air pressure within said reservoir is above said high pressure level said pressure switch is open and wherein when said air pressure within said reservoir is below said low pressure level said pressure switch is closed.

15. The sprayer system of claim 14, wherein said high pressure level and said low pressure level are manually adjustable.

16. The sprayer system of claim 15, including an air filter manifold fluidly connected to said air compressor by an intake tube.

17. The sprayer system of claim 16, wherein said supply tube includes a check valve.

18. The sprayer system of claim 17, including a safety valve within said reservoir for allowing the release of pressure within said reservoir if said air pressure rises above a dangerous level.

19. The sprayer system of claim 18, wherein said battery is rechargeable.

* * * * *